US012221707B2

(12) United States Patent
Jo et al.

(10) Patent No.: US 12,221,707 B2
(45) Date of Patent: Feb. 11, 2025

(54) ACID-RESISTANT STEEL SHEET AND MANUFACTURING METHOD THEREFOR

(71) Applicant: POSCO, Pohang-si (KR)

(72) Inventors: Minho Jo, Pohang-si (KR); Byoung Ho Lee, Pohang-si (KR); Young-Kwang Hong, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 820 days.

(21) Appl. No.: 17/297,938

(22) PCT Filed: Nov. 26, 2019

(86) PCT No.: PCT/KR2019/016378
§ 371 (c)(1),
(2) Date: May 27, 2021

(87) PCT Pub. No.: WO2020/111734
PCT Pub. Date: Jun. 4, 2020

(65) Prior Publication Data

US 2022/0042179 A1 Feb. 10, 2022

(30) Foreign Application Priority Data

Nov. 30, 2018 (KR) ..... 10-2018-0153136

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23F 11/04*** | (2006.01) |

(52) U.S. Cl.
CPC ..... *C23F 11/04* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01)

(58) Field of Classification Search
CPC ..... C21D 9/46
See application file for complete search history.

(56) References Cited

U.S. PATENT DOCUMENTS

2013/0149187 A1 6/2013 Inoue et al.

FOREIGN PATENT DOCUMENTS

| | | | |
|---|---|---|---|
| CN | 102732799 | A | 10/2012 |
| JP | 2000-073139 | A | 3/2000 |
| JP | 2003-328099 | A | 11/2003 |
| JP | 2004-068039 | A | 3/2004 |
| JP | 2007-239094 | A | 9/2007 |
| JP | 2007-239095 | A | 9/2007 |
| JP | 2008-121045 | A | 5/2008 |
| JP | 2010-089127 | A | 4/2010 |
| JP | 2013-256713 | A | 12/2013 |
| JP | 5977854 | B1 | 8/2016 |
| KR | 10-1997-0007035 | B1 | 5/1997 |
| KR | 10-0694697 | B1 | 3/2007 |
| KR | 10-0833050 | B1 | 5/2008 |
| KR | 10-1197955 | B1 | 11/2012 |
| KR | 10-2015-0140423 | A | 12/2015 |
| KR | 10-1726075 | B1 | 4/2017 |
| KR | 10-1889193 | B1 | 8/2018 |
| WO | 2009/084747 | A1 | 7/2009 |

OTHER PUBLICATIONS

English machine translation of JP 2003-328099 A of Ikematsu (Year: 2003).*
International Search Report and Written Opinion issued in corresponding International Patent Application No. PCT/KR2019/016378 dated Jul. 2, 2020, with English translation.

* cited by examiner

*Primary Examiner* — Jophy S. Koshy
(74) *Attorney, Agent, or Firm* — Morgan, Lewis & Bockius LLP

(57) ABSTRACT

An acid-resistant steel sheet according to an embodiment of the present invention includes, by wt %, equal to or less than 0.1% of C (excluding 0%) and 2.0 to 4.0% of Si, and includes a remainder of Fe and inevitable impurities, and the content of Si of the surface portion by the inward depth of up to 10 μm from the surface of the steel sheet is equal to or greater than 15 wt %.

5 Claims, 1 Drawing Sheet

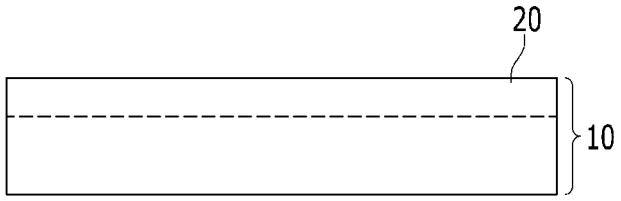
20
10

ACID-RESISTANT STEEL SHEET AND MANUFACTURING METHOD THEREFOR

CROSS REFERENCE

This application is the U.S. National Phase under 35 U.S.C. § 371 of International Application No. PCT/KR2019/016378 filed on Nov. 26, 2019, which claims the benefit of Korean Application No. 10-2018-0153136 filed on Nov. 30, 2018, the entire contents of each are hereby incorporated by reference.

TECHNICAL FIELD

The present disclosure relates to an acid-resistant steel sheet and a manufacturing method thereof. In particular, it relates to a steel sheet with excellent corrosion resistance against corrosion generated by various types of acids and having excellent workability, and a manufacturing method thereof.

BACKGROUND ART

During a process for combusting a fossil fuel so as to generate heat energy, vapor is generated with toxic exhaust gas such as sulfuric acid gas or nitric acid gas, and during a process for cooling them, condensed water containing various kinds of strong acids such as sulfuric acid, hydrochloric acid, or nitric acid is generated to thus corrode an exhaust system. In addition, acid solutions are frequently used as rinsing solutions in various industrial facilities, so corrosion by acids is caused. When a steel sheet is exposed to such an acid environment, the steel sheet is quickly corroded and its thickness is reduced, so it loses the function as a structural material. Therefore, the steel sheet used in the acid contacting environment needs to have improved corrosion resistance against the acids for the purpose of increasing its lifespan. Further, to use the steel sheet as a desired type of structure, more than a predetermined level of mechanical properties must be satisfied for formation. To supplement corrosion resistance of a cold-rolled steel sheet, a method for improving corrosion resistance by hot-dipping Al on the steel sheet is proposed. An aluminum-plated steel sheet represents a carbon steel on which aluminum is plated, and it has corrosion resistance by a passive film of $Al_2O_3$, and particularly, it has a very strong merit of corrosion resistance against corrosion by salt. However, in a strong acid environment with a low pH, Al has the limit of being eluted, being easily removed, and failing to maintain corrosion resistance. To solve this drawback, a method for suppressing corrosion in a strong acid environment with a low pH by adding Cu to the steel sheet is proposed. When Cu is added, Cu is thickened on the surface during a corroding process, thereby reducing a corrosion rate, but the level of corrosion resistance by an addition of Cu has a limit, so a method for further improving corrosion resistance is needed. Also, when a large amount of Cu is added, cracks may be generated as drawbacks on the surface during a process for producing a steel sheet. As a method for substantially improving corrosion resistance of the steel sheet, a method for manufacturing a stainless steel sheet by adding a large amount of various alloying elements including Cr is described. The stainless steel sheet also has corrosion resistance caused by a passive film of $Cr_2O_3$ within a predetermined pH range, but the passive film of $Cr_2O_3$ is activated in the strong acid environment with a low pH and loses corrosion resistance.

In addition, a large amount of expensive alloying elements are added and economic feasibility is reduced as a drawback.

DISCLOSURE

Description of the Drawings

The present invention has been made in an effort to provide an acid-resistant steel sheet and a manufacturing method thereof. In detail, the present invention has been made in an effort to provide a steel sheet with excellent corrosion resistance against corrosion generated by various acids and having excellent workability, and a manufacturing method thereof.

An embodiment of the present invention provides an acid-resistant steel sheet including, by wt %, equal to or less than 0.1% of C (excluding 0%) and 2.0 to 4.0% of Si, and including a remainder of Fe and inevitable impurities, wherein the content of Si of the surface portion by the inward depth of up to 10 μm from the surface of the steel sheet is equal to or greater than 15 wt %.

The acid-resistant steel sheet may further include at least one of 0.1 to 0.5 wt % of Mn, equal to or less than 0.1 wt % of Al, equal to or less than 0.01 wt % of P, equal to or less than 0.01 wt % of S, and equal to or less than 0.01 wt % of N.

The acid-resistant steel sheet may further include equal to or less than 0.1 wt % of Cr, equal to or less than 0.1 wt % of Ni, equal to or less than 0.1 wt % of Cu, equal to or less than 0.1 wt % of Nb, and equal to or less than 0.1 wt % of Mo.

When soaked for an hour in a 1 wt % sulfuric acid solution at 70° C., an average corrosion rate may be equal to or less than 3.5 $mg/cm^2 \cdot h$.

An elongation rate may be equal to or greater than 30%.

Another embodiment of the present invention provides a method for manufacturing an acid-resistant steel sheet, including: heating a slab including, by wt %, equal to or less than 0.1% of C (excluding 0%) and 2.0 to 4.0% of Si, and comprising a remainder of Fe and inevitable impurities; manufacturing a hot rolled steel sheet by hot rolling the slab; and acidifying the hot rolled steel sheet in an acid aqueous solution of equal to or greater than 25 wt % for ten seconds or more.

The heating of a slab may include heating the slab at equal to or greater than 1200° C.

In the manufacturing of hot rolled steel sheet, a finish rolling temperature may be equal to or greater than $Ar_3$.

A temperature of $Ar_3$ (° C.) may be calculated as follows:

$$Ar3=910-310\times[C]-80\times[Mn]-20\times[Cu]-15\times[Cr]-55\times[Ni]-80\times[Mo]-(0.35\times(25.4-8)),$$ with [X] indicating a concentration in wt % of element X.

The method may further include, after the manufacturing of a hot rolled steel sheet, winding the hot rolled steel sheet at 550 to 750° C.

The method may further include, after the manufacturing of a hot rolled steel sheet, cold rolling the hot rolled steel sheet.

The method may further include, after the manufacturing of a hot rolled steel sheet, annealing the hot rolled steel sheet.

The acid-resistant steel sheet according to an embodiment of the present invention has excellent acid resistance and workability.

The acid-resistant steel sheet according to an embodiment of the present invention may obtain excellent acid resistance and workability without adding expensive alloying components such as Cr.

The acid-resistant steel sheet according to an embodiment of the present invention includes a thickening layer of Si, thereby having excellent corrosion resistance in a corrosion environment by acids, and efficiently extending the lifespan of the material.

BRIEF DESCRIPTION OF THE DRAWING

FIG. 1 shows a cross-sectional view of an acid-resistant steel sheet according to an embodiment of the present invention.

MODE FOR INVENTION

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The technical terms used herein are to simply mention a particular exemplary embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

Unless mentioned in a predetermined way, % represents wt %, and 1 ppm is 0.0001 wt %.

In an exemplary embodiment of the present invention, "further including an additional element" signifies including the additional element in substitute for iron (Fe) that is a remainder.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the meanings equal to the contextual meanings in the relevant field of art, and are not to be interpreted to have idealized or excessively formal meanings unless clearly defined in the present application.

An exemplary embodiment of the present invention will be described more fully hereinafter so that a person skilled in the art may easily realize the same. As those skilled in the art would realize, the described embodiments may be modified in various different ways, all without departing from the spirit or scope of the present invention.

The acid-resistant steel sheet according to an embodiment of the present invention relates to a steel sheet used in the environment in which corrosion by the acid happens. The material used for that purpose must have corrosion resistance on the acid environment for extending its lifespan and must simultaneously have workability for formation into a desired shape.

When an excessive amount of expensive alloying elements is added so as to increase the acid resistance, a cost of the material increases to lower the economic feasibility and result in the reduction of workability. Therefore, a method for simultaneously obtaining corrosion resistance and workability without adding a large amount of expensive alloying elements is needed.

The acid-resistant steel sheet according to an embodiment of the present invention includes a thickening layer of Si on the surface portion, thereby having excellent corrosion resistance in a corrosion environment by acids, and efficiently extending the lifespan of the material.

FIG. 1 shows a cross-sectional view of an acid-resistant steel sheet according to an embodiment of the present invention. As shown in FIG. 1, a surface portion 20 is provided in an inner direction from a surface of the acid-resistant steel sheet 10. FIG. 1 shows that the surface portion 20 is positioned on one side, and it may be positioned on respective sides.

The acid-resistant steel sheet 10 according to an embodiment of the present invention includes, by wt %, equal to or less than 0.1% of C (excluding 0%) and 2.0 to 4.0% of Si, and includes a remainder of Fe and inevitable impurities.

Respective components will now be described in detail.

Carbon (C): Equal to or Less than 0.1 wt %

As the content of C increases, its intensity increases, so an appropriate amount of C is added to obtain desired yield strength and tensile strength. However, when the content of C is very large, its elongation rate is reduced, and formability may be deteriorated. Therefore, equal to or less than 0.1 wt % of C may be included. In detail, 0.001 to 0.1 wt % of C may be included. In detail, 0.01 to 0.09 wt % of C may be included.

Silicon (Si): 2.0 to 4.0 wt %

Si is an element that may be used as a decarburization agent when a small amount thereof is added, and it may support the improvement of strength caused by solid solution strengthening. In an embodiment of the present invention, Si is a very important added element, and a Si-based oxidation layer is formed on the surface by addition of Si and surface thickening, thereby substantially improving the corrosion resistance against the acid. When a very small amount of Si is added, it is difficult to obtain the above-noted effect. On the contrary, when a very large amount of Si is added, workability may be substantially deteriorated by formation of a B2 or DO3 phase. Therefore, 2.0 to 4.0 wt % of Si may be included. In detail, 2.5 to 3.5 wt % of Si may be included.

The acid-resistant steel sheet 10 according to an embodiment of the present invention may further include at least one of 0.1 to 0.5 wt % of Mn, equal to or less than 0.1 wt % of Al, equal to or less than 0.01 wt % of P, equal to or less than 0.01 wt % of S, and equal to or less than 0.01 wt % of N.

Manganese (Mn): 0.1 to 0.5 wt %

The manganese (Mn) is an element combined with the solid solution S in the steel and precipitated into MnS to thus prevent hot shortness caused by the solid solution S. To achieve such an effect, equal to or greater than 0.1 wt % thereof may be included when Mn is further included. However, when greater than 0.5 wt % of Mn is included, the material may be hardened and flexibility may be worsened. In detail, 0.15 to 0.35 wt % of Mn may be included.

Aluminum (Al): Equal to or Less than 0.1 wt %

Al is an element with a very large deoxidizing effect, and it reacts to N in the steel to precipitate AlN, and thereby prevent deterioration of formability caused by the solid solution N, so it may be further included. However, when a large amount thereof is added, flexibility is steeply deteriorated, and the content is limited to equal to or less than 0.1 wt %. In detail, 0.01 to 0.05 wt % of Al may be further included.

Phosphorus (P): Equal to or Less than 0.01 wt %

An addition of P by a predetermined amount or less does not substantially reduce the flexibility of the steel but increases the rigidity, but when it is greater than 0.01 wt %, it segregates to the grain boundary and hardens the steel, so it may be limited to be equal to or less than 0.01 wt %. In detail, 0.001 to 0.01 wt % of P may be further included.

Sulfur (S): Equal to or Less than 0.01 wt %

S is an element of generating hot shortness in the solid solution, so precipitation of MnS must be induced by adding Mn. However, excessive precipitation of MnS hardens the steel, which is not desirable. Therefore, an upper limit of S is restricted to 0.01 wt %. In detail, 0.001 to 0.01 wt % of S may be further included.

Nitrogen (N): Equal to or Less than 0.01 wt %

N is frequently contained in the steel as an inevitable element, and N that fails to be precipitated but exists as a solid solution reduces flexibility, worsens aging resistance, and lowers workability. When it is combined to an element such as Ti or Nb to form a deposition, corrosion resistance is substantially worsened so the upper limit is restricted to 0.01 wt %. In detail, 0.001 to 0.005 wt % of N may be further included.

The acid-resistant steel sheet 10 according to an embodiment of the present invention may include equal to or less than 0.01 wt % of C, 2.0 to 4.0 wt % of Si, 0.1 to 0.5 wt % of Mn, equal to or less than 0.1 wt % of Al, equal to or less than 0.01 wt % of P, equal to or less than 0.01 wt % of S, and equal to or less than 0.01 wt % of N, and may include a remainder of Fe and other inevitable impurities. In detail, the acid-resistant steel sheet 10 according to an embodiment of the present invention may include equal to or less than 0.01 wt % of C, 2.0 to 4.0 wt % of Si, 0.1 to 0.5 wt % of Mn, equal to or less than 0.1 wt % of Al, equal to or less than 0.01 wt % of P, equal to or less than 0.01 wt % of S, and equal to or less than 0.01 wt % of N, and may include a remainder of Fe and other inevitable impurities.

In addition to the above-described alloying composition, the remainder includes Fe and inevitable impurities. However, an embodiment of the present invention does not exclude addition of other compositions. The inevitable impurities may be unintentionally mixed from the raw materials or environments in the conventional steel manufacturing process, which may not be excluded. The inevitable impurities may be understood to a person skilled in the art. For example, equal to or less than 0.1 wt % of Cr, equal to or less than 0.1 wt % of Ni, equal to or less than 0.1 wt % of Cu, equal to or less than 0.1 wt % of Nb, equal to or less than 0.1 wt % of Ti, and equal to or less than 0.1 wt % of Mo may be included thereto.

In an embodiment of the present invention, the content of Si of the surface portion 20 by the depth of up to 10 μm in the internal direction from the steel sheet surface may be equal to or greater than 15 wt %.

The above-noted alloying composition is an alloying composition of the entire steel sheet 10 including the surface portion 20, and does not exclude the surface portion 20.

The remaining content excluding the content of Si in the surface portion 20 corresponds to the alloying composition of the steel sheet 10, and it may further include 5 to 50 wt % of O. A concentration gradient of Si may exist in the surface portion 20, and the expression that the content of Si is equal to or greater than 15% signifies the average of the entire thickness of the surface portion 20.

In an embodiment of the present invention, as the obtained content of Si of the surface portion 20 is equal to or greater than 15 wt %, corrosion resistance is acquired. In detail, the content of Si of the surface portion 20 may be equal to or greater than 20 wt %. In detail, it may be 20 to 35 wt %.

A method for forming the surface portion 20 will be described in detail in a method for manufacturing an acid-resistant steel sheet to be described, so no repeated descriptions will be provided.

As described, as the surface portion 20 exists, excellent corrosion resistance and simultaneously excellent workability may be obtained.

In detail, when it is soaked in a 1 wt % sulfuric acid solution at 70° C. for one hour, an average corrosion rate may be equal to or less than 3.5 $mg/cm^2 \cdot h$. The elongation rate may be equal to or greater than 30%. In detail, when it is soaked in the sulfuric acid solution of 1 wt % at 70° C. for one hour, the average corrosion rate may be 1.0 to 3.0 $mg/cm^2 \cdot h$. The elongation rate may be 30 to 40%.

The method for manufacturing an acid-resistant steel sheet according to an embodiment of the present invention includes: heating a slab; manufacturing a hot rolled steel sheet by hot rolling the slab; and acidifying the hot rolled steel sheet in an acid aqueous solution of equal to or greater than 25 wt % for ten seconds or more.

Respective stages will now be described in detail.

First, the slab is heated.

The alloying composition of the slab has been described regarding the above-described acid-resistant steel sheet, so no repeated descriptions will be described. The alloying component is not substantially changed in the process for manufacturing an acid-resistant steel sheet, so the alloying composition of the acid-resistant steel sheet substantially corresponds to the alloying composition of the slab.

The temperature of heating the slab may be equal to or greater than 1200° C. Most of the deposition existing in the steel must be solidified, so a temperature of equal to or greater than 1200° C. may be needed. In detail, the slab heating temperature may be equal to or greater than 1250° C.

The slab is hot rolled to manufacture a hot rolled steel sheet.

In this instance, a finish rolling temperature may be equal to or greater than $Ar_3$.

The temperature of $Ar_3$ may be calculated as follows:

$$Ar3=910-310\times[C]-80\times[Mn]-20\times[Cu]-15\times[Cr]-55\times[Ni]-80\times[Mo]-(0.35\times(25.4-8))$$

This is to perform rolling on an austenite single phase.

After manufacturing the hot rolled steel sheet, the hot rolled steel sheet may further be wound at 550 to 750° C. By winding the same at equal to or greater than 550° C., N remaining as a solid solution may be additionally precipitated into AlN, thereby acquiring excellent aging resistance. When winding the same at less than 550° C., the workability may be reduced by the solid solution of N that is not precipitated into AlN but remains. When winding the same at equal to or greater than 750° C., grains may be coarsened to reduce the cold rolling property.

After manufacturing the hot rolled steel sheet, the hot rolled steel sheet may further be cold rolled. Further, after manufacturing the hot rolled steel sheet, the hot rolled steel sheet may further be annealed. The cold rolling and the annealing are known to a person skilled in the art, so no detailed descriptions thereof will be provided.

The hot rolled steel sheet is acidified in the acid aqueous solution of equal to or greater than 25 wt % for ten seconds or more.

In an embodiment of the present invention, excellent acid resistance may be obtained by thickening Si on the surface portion 20 through the acidification.

As the acid, an inorganic acid or an organic acid may be used. In detail, at least one of sulfuric acid, hydrochloric acid, and nitric acid may be used. In detail, the hydrochloric acid may be used.

The acid concentration is equal to or greater than 25 wt %, and it may be processed for ten seconds or more. When the acid concentration is low or a time is short, Si is not appropriately thickened, and it is difficult to obtain the corrosion resistance. In detail, the acid concentration is 25 to 50 wt %, and it may be processed for 10 to 60 seconds.

The present invention will now be described in detail through an embodiment. However, the embodiment illustrates the present invention, and the present invention is not limited thereto.

Embodiment

The steel having the composition of Table 1 is manufactured, and the components indicate results. The steel slab with the composition of Table 1 is heated again at 1250° C. to perform hot rolling at 900° C. or more, it is wound at 620° C., and surface processing is performed through the hydrochloric acid in the acidification condition of Table 1 to thus finally obtain the hot rolled steel sheet that is 3 mm thick.

TABLE 1

| | Components (wt %) | | | | | | | Acidification conditions | |
|---|---|---|---|---|---|---|---|---|---|
| | | | | | | | | Concentration | Time |
| | C | Si | Mn | Al | P | S | N | (wt %) | (s) |
| Developing steel 1 | 0.003 | 3.10 | 0.21 | 0.035 | 0.008 | 0.007 | 0.0028 | 50 | 10 |
| Developing steel 2 | 0.021 | 2.96 | 0.20 | 0.040 | 0.007 | 0.008 | 0.0029 | 50 | 10 |
| Developing steel 3 | 0.045 | 3.00 | 0.20 | 0.038 | 0.008 | 0.007 | 0.0030 | 50 | 10 |
| Developing steel 4 | 0.060 | 3.09 | 0.19 | 0.040 | 0.008 | 0.007 | 0.0027 | 50 | 10 |
| Developing steel 5 | 0.082 | 3.07 | 0.20 | 0.036 | 0.007 | 0.007 | 0.0030 | 50 | 10 |
| Developing steel 6 | 0.098 | 2.92 | 0.21 | 0.036 | 0.007 | 0.008 | 0.0028 | 50 | 10 |
| Developing steel 7 | 0.057 | 2.15 | 0.21 | 0.034 | 0.008 | 0.008 | 0.0029 | 50 | 10 |
| Developing steel 8 | 0.058 | 2.96 | 0.20 | 0.031 | 0.008 | 0.008 | 0.0029 | 50 | 10 |
| Developing steel 9 | 0.058 | 3.62 | 0.20 | 0.038 | 0.007 | 0.008 | 0.0027 | 50 | 10 |
| Developing steel 10 | 0.059 | 3.09 | 0.20 | 0.036 | 0.008 | 0.007 | 0.0030 | 25 | 10 |
| Developing steel 11 | 0.055 | 2.91 | 0.19 | 0.036 | 0.008 | 0.007 | 0.0027 | 50 | 10 |
| Developing steel 12 | 0.054 | 3.04 | 0.21 | 0.034 | 0.008 | 0.007 | 0.0028 | 80 | 10 |
| Developing steel 13 | 0.054 | 2.98 | 0.19 | 0.035 | 0.008 | 0.008 | 0.0029 | 50 | 10 |
| Developing steel 14 | 0.053 | 3.08 | 0.21 | 0.031 | 0.007 | 0.008 | 0.0030 | 50 | 20 |
| Developing steel 15 | 0.058 | 3.07 | 0.19 | 0.035 | 0.007 | 0.008 | 0.0030 | 50 | 30 |
| Developing steel 16 | 0.053 | 3.05 | 0.21 | 0.039 | 0.007 | 0.008 | 0.0027 | 50 | 60 |
| Comparative steel 1 | 0.125 | 2.93 | 0.19 | 0.034 | 0.008 | 0.007 | 0.0029 | 50 | 10 |
| Comparative steel 2 | 0.058 | 0.52 | 0.20 | 0.036 | 0.007 | 0.008 | 0.0028 | 50 | 10 |
| Comparative steel 3 | 0.054 | 1.52 | 0.19 | 0.040 | 0.007 | 0.008 | 0.0028 | 50 | 10 |
| Comparative steel 4 | 0.058 | 4.22 | 0.19 | 0.040 | 0.008 | 0.008 | 0.0029 | 50 | 10 |
| Comparative steel 5 | 0.055 | 5.01 | 0.20 | 0.039 | 0.008 | 0.008 | 0.0027 | 50 | 10 |
| Comparative steel 6 | 0.056 | 3.07 | 0.19 | 0.034 | 0.008 | 0.008 | 0.0029 | 5 | 10 |
| Comparative steel 7 | 0.059 | 3.03 | 0.21 | 0.037 | 0.008 | 0.007 | 0.0030 | 10 | 10 |
| Comparative steel 8 | 0.054 | 2.92 | 0.20 | 0.038 | 0.007 | 0.008 | 0.0029 | 20 | 10 |
| Comparative steel 9 | 0.051 | 3.07 | 0.20 | 0.032 | 0.008 | 0.008 | 0.0030 | 50 | 1 |

TABLE 1-continued

| | Components (wt %) | | | | | | | Acidification conditions | |
|---|---|---|---|---|---|---|---|---|---|
| | | | | | | | | Concentration | Time |
| | C | Si | Mn | Al | P | S | N | (wt %) | (s) |
| Comparative steel 10 | 0.051 | 3.02 | 0.21 | 0.039 | 0.007 | 0.008 | 0.0030 | 50 | 2 |
| Comparative steel 11 | 0.059 | 2.90 | 0.20 | 0.037 | 0.008 | 0.007 | 0.0027 | 50 | 5 |

The content of Si contained in the surface portion up to the depth of 10 μm from the surface for the respective manufactured hot rolled steel sheets is measured by using an energy dispersive spectrometer (EDS). They are corroded in the sulfuric acid solution of 1 wt % at 70° C. for an hour, and the average corrosion rate thereof is measured to estimate the acid resistance, and mechanical properties are estimated through a room-temperature tension test. Measured content of Si of the surface portion, the average corrosion rates, and elongation rates are expressed in Table 2.

TABLE 2

| Categories | Si concentration of surface portion (wt %) | Fe concentration of surface portion (wt %) | Average corrosion rates ($mg/cm^2/h$) | Elongation rates (%) |
|---|---|---|---|---|
| Developing steel 1 | 21.2 | 57.8 | 2.34 | 37.1 |
| Developing steel 2 | 20.3 | 59.2 | 2.14 | 36.0 |
| Developing steel 3 | 24.5 | 51.2 | 2.36 | 35.7 |
| Developing steel 4 | 23.6 | 52.7 | 2.19 | 34.8 |
| Developing steel 5 | 24.7 | 51.1 | 2.41 | 32.3 |
| Developing steel 6 | 22.0 | 55.5 | 2.43 | 30.1 |
| Developing steel 7 | 16.1 | 68.0 | 2.99 | 36.8 |
| Developing steel 8 | 22.8 | 54.3 | 2.13 | 35.9 |
| Developing steel 9 | 26.2 | 47.3 | 1.89 | 30.1 |
| Developing steel 10 | 20.8 | 58.9 | 2.83 | 34.2 |
| Developing steel 11 | 23.5 | 53.4 | 2.27 | 34.6 |
| Developing steel 12 | 21.2 | 57.4 | 1.82 | 35.5 |
| Developing steel 13 | 20.3 | 59.0 | 2.46 | 34.1 |
| Developing steel 14 | 25.6 | 48.6 | 1.95 | 34.2 |
| Developing steel 15 | 28.8 | 42.7 | 1.74 | 34.3 |
| Developing steel 16 | 32.6 | 34.9 | 1.52 | 34.8 |
| Comparative steel 1 | 25.0 | 49.6 | 2.12 | 28.3 |
| Comparative steel 2 | 1.5 | 97.8 | 33.46 | 40.1 |
| Comparative steel 3 | 8.5 | 83.3 | 5.88 | 39.1 |
| Comparative steel 4 | 28.6 | 42.6 | 1.72 | 18.6 |
| Comparative steel 5 | 30.5 | 38.7 | 1.66 | 5.9 |
| Comparative steel 6 | 1.2 | 98.5 | 40.23 | 35.2 |

TABLE 2-continued

| Categories | Si concentration of surface portion (wt %) | Fe concentration of surface portion (wt %) | Average corrosion rates ($mg/cm^2/h$) | Elongation rates (%) |
|---|---|---|---|---|
| Comparative steel 7 | 6.5 | 86.8 | 7.69 | 35.1 |
| Comparative steel 8 | 12.2 | 75.8 | 4.10 | 35.7 |
| Comparative steel 9 | 2.1 | 96.6 | 22.89 | 34.1 |
| Comparative steel 10 | 4.6 | 90.3 | 10.87 | 35.3 |
| Comparative steel 11 | 10.1 | 79.6 | 4.95 | 34.5 |

As expressed in Table 2, it is found that the invention steels 1 to 16 satisfying the composition of the present invention and the manufacturing conditions have the content of Si of the surface portion that is equal to or greater than 15 wt %, the average corrosion rate is excellent in the sulfuric acid corroding test, and the elongation rate is excellent.

It is found that Comparative steel 1 has a very large content of C and its workability is reduced.

Comparative steels 2 and 3 have a low content of Si and a low content of Si of the surface portion. It is accordingly found that the corrosion rate substantially increases. On the contrary, Comparative steels 4 and 5 have a high content of Si, and have a high content Si of the surface portion in this instance. It is found that the corrosion rate is excellent but the elongation rate is very bad. This is because of formation of the B2 or DO3 phase caused by a regular arrangement of Si and Fe, and when the corresponding phase is generated, it is analyzed as that a movement of potential is not free and the elongation rate is substantially reduced.

Comparative steels 6 to 8 had the low concentration of the acid aqueous solution, and the thickening of Si of the surface portion is insufficient, so the average corrosion rate is very bad.

It is found that Comparative steels 9 to 11 have a very short acidification time, so the thickening of Si of the surface portion is insufficient, and the average corrosion rate is very bad.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims. Therefore, the embodiments described above are only examples and should not be construed as being limitative in any respects.

DESCRIPTION OF SYMBOLS

10: acid-resistant steel sheet,
20: surface portion

The invention claimed is:

1. An acid-resistant hot-rolled steel sheet comprising, by wt %, equal to or less than 0.1% of C excluding 0% and 2.0 to 4.0% of Si, and a remainder of Fe and inevitable impurities, wherein the content of Si of the surface portion by the inward depth of up to 10 μm from the surface of the steel sheet is equal to or greater than 15 wt %.

2. The acid-resistant hot-rolled steel sheet of claim 1, further comprising at least one of 0.1 to 0.5 wt % of Mn, equal to or less than 0.1 wt % of Al, equal to or less than 0.01 wt % of P, equal to or less than 0.01 wt % of S, and equal to or less than 0.01 wt % of N.

3. The acid-resistant hot-rolled steel sheet of claim 1, further comprising equal to or less than 0.1 wt % of Cr, equal to or less than 0.1 wt % of Ni, equal to or less than 0.1 wt % of Cu, equal to or less than 0.1 wt % of Nb, and equal to or less than 0.1 wt % of Mo.

4. The acid-resistant hot-rolled steel sheet of claim 1, wherein when soaked for an hour in a 1 wt % sulfuric acid solution at 70° C., an average corrosion rate is equal to or less than 3.5 $mg/cm^2 \cdot h$.

5. The acid-resistant hot-rolled steel sheet of claim 1, wherein an elongation rate is equal to or greater than 30%.

* * * * *